United States Patent [19]

Claxton et al.

[11] 4,230,273

[45] Oct. 28, 1980

[54] FUEL INJECTION VALVE AND SINGLE POINT SYSTEM

[75] Inventors: William B. Claxton, W. Bloomfield, Mich.; Joseph C. Cromas, Newport News, Va.

[73] Assignee: The Bendix Corporation, Southfield, Mich.

[21] Appl. No.: 875,828

[22] Filed: Feb. 7, 1978

[51] Int. Cl.[2] ..... F02M 51/08; F02M 61/06; F02M 61/14

[52] U.S. Cl. ..... 239/125; 239/488; 239/489; 239/492; 239/585; 239/600

[58] Field of Search ..... 239/124–126, 239/488, 492, 585, 489, 600; 123/32 RE, 32 AB, 32 JV, 32 EA, 119 R, 139 AW, 139 AT, 139 AK

[56] References Cited

U.S. PATENT DOCUMENTS

| | | | |
|---|---|---|---|
| 2,812,979 | 11/1957 | Ziesche et al. | 239/488 X |
| 3,241,768 | 3/1966 | Croft | 239/585 X |
| 3,519,407 | 7/1970 | Hilborn | 123/139 R X |
| 3,692,245 | 9/1972 | Needham et al. | 239/488 |
| 3,720,403 | 3/1973 | Winquist et al. | 123/32 RX |
| 3,778,038 | 12/1973 | Eversole et al. | 123/119 R X |
| 3,783,844 | 1/1974 | Gural | 123/139 AW X |
| 3,788,287 | 1/1974 | Falen et al. | 123/119 R X |
| 3,890,946 | 6/1975 | Wahl | 123/32 EA X |
| 3,931,814 | 1/1976 | Rivere | 123/119 R |
| 3,953,548 | 4/1976 | Knapp et al. | 261/50 A |
| 4,130,095 | 12/1978 | Bowler et al. | 123/32 EE |
| 4,149,496 | 4/1979 | Palma | 123/32 AE |

FOREIGN PATENT DOCUMENTS

| | | | |
|---|---|---|---|
| 1604941 | 5/1970 | Fed. Rep. of Germany | 239/492 |
| 2034078 | 1/1972 | Fed. Rep. of Germany | 239/585 |

*Primary Examiner*—Andres Kashnikow

*Attorney, Agent, or Firm*—William A. Marvin; Russel C. Wells

[57] ABSTRACT

An electromagnetically actuated fuel injection valve and its utilization in a dual plane, single point fuel injection system are disclosed. The single point injection system includes a throttle body having an air induction bore controlled by a throttle assembly for each plane of the internal combustion engine manifold. An integrally formed fuel injector jacket mounts an injector valve above the throttle blade and concentrically with each bore of the throttle body without a hard fuel connection to the valve. The injection valve includes a movable valve needle attached to the armature of an electromagnetic solenoid. The needle seats between an inlet orifice and a metering orifice of a valve housing which is inserted into the accumulation chamber defined by the inner wall of the injector jacket. A flexible or soft connection is maintained between the valve housing and injector jacket to seal the accumulator chamber and to provide for quickly mounting or removing the valve from the system.

10 Claims, 21 Drawing Figures

Fig-1
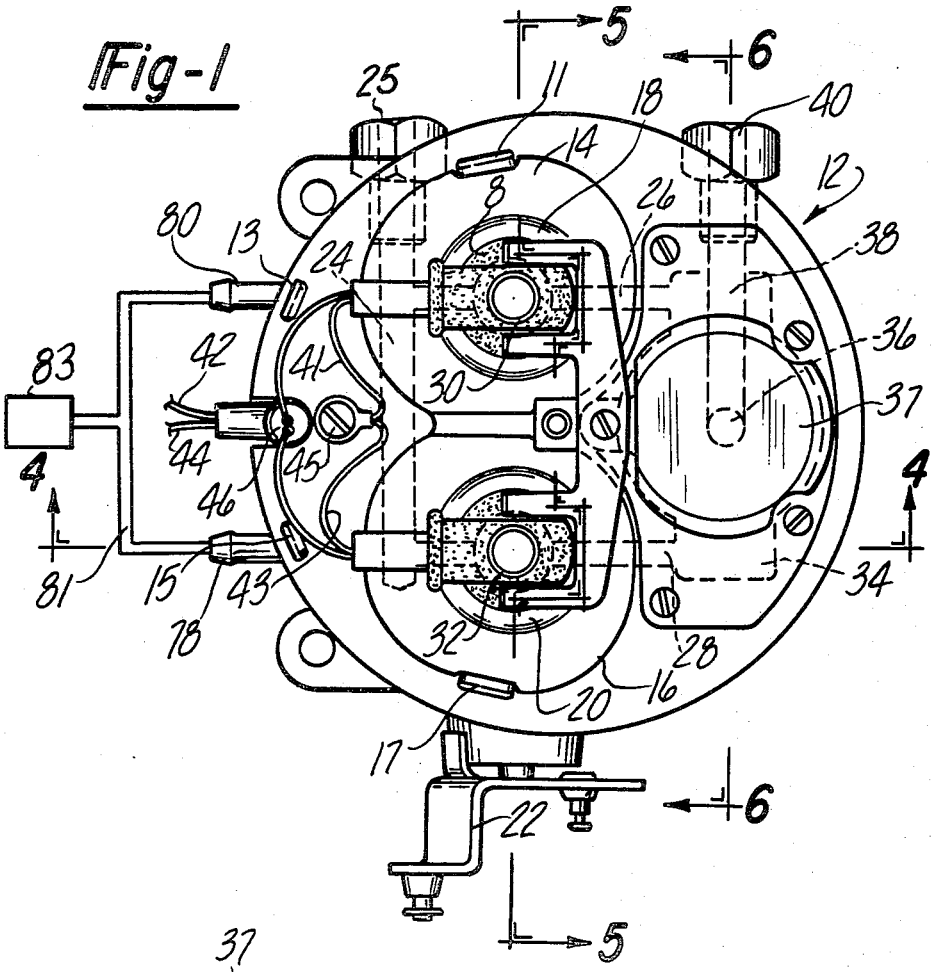
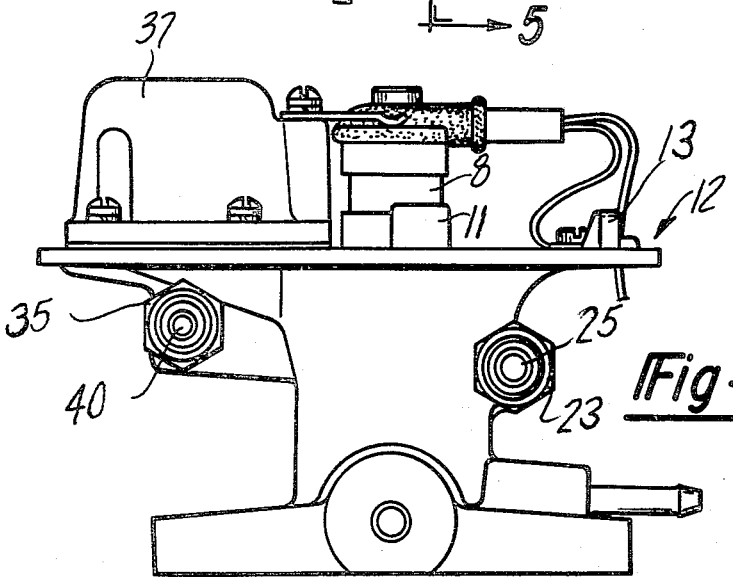
Fig-2

Fig-8
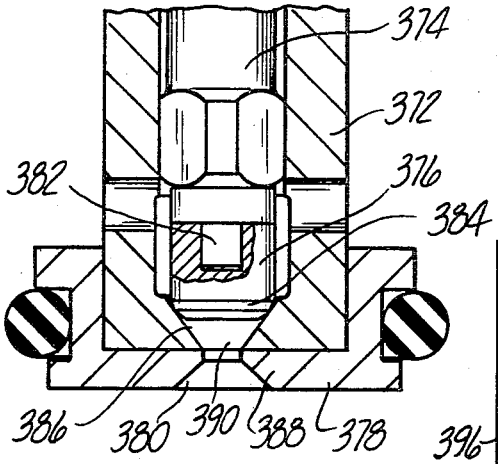
Fig-9
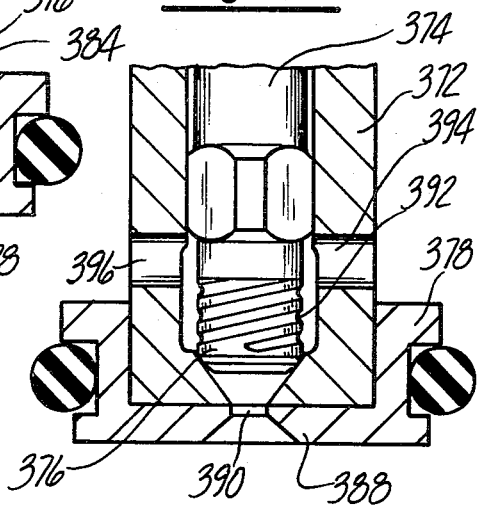
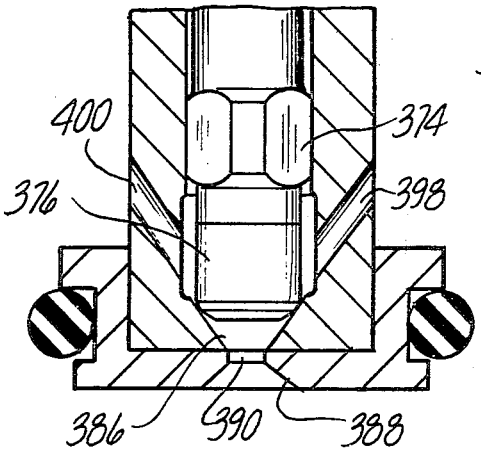
Fig-10
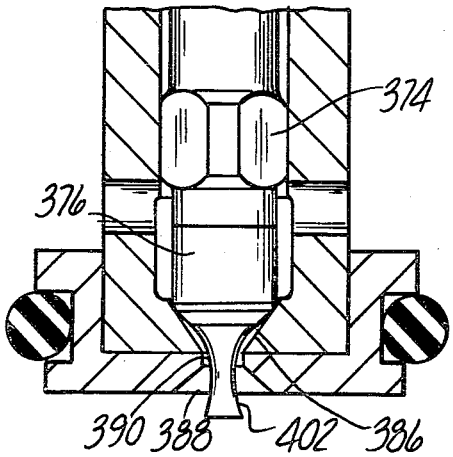
Fig-11

FUEL INJECTION VALVE AND SINGLE POINT SYSTEM

CROSS REFERENCE TO RELATED APPLICATIONS

The present application is related to application Ser. No. 875,832 filed in the name of Gary Lee Casey and application Ser. No. 875,833 filed in the name of Angelo Raymond Melotti, all of which are commonly assigned.

BACKGROUND OF THE INVENTION

The invention pertains generally to electronic fuel injection systems and is more particularly directed to fuel delivery metering apparatus for such systems.

The majority of automobiles being built today have fuel systems which are either controlled by means of a carburetor or a fuel injection system. The system being described herein is calculated to combine the advantages of both systems and either solve or ameliorate many of the inherent problems of the two systems.

In the case of a carburetor, while it has an advantage of low cost and low operating fuel pressure, there are many undesirable characteristics inherent to the use of a carburetor. For example, the operation of a carburetor requires a continuous flow of fuel, the quantity of fuel being determined on the position of the throttle. It has been found that the fuel is not properly atomized and entrained in the air flow through the throat of the carburetor. Without proper atomization, the fuel distribution to the various cylinders is uneven thereby causing a rich or lean mixture from one cylinder to another. This situation increases the objectionable emissions from the particular cylinder which is too rich or too lean relative to stoichiometric. Also, relative to a fuel injection system, the carburetted system is inherently inaccurate in its fuel control whereby all of the cylinders may be operating at a point different from optimum.

Further, carburetted systems are typically operated in an open loop mode of operation. With this type of operation, the output of the engine exhaust system is not sensed to determine the quality of combustion which is occurring in the engine. Under these circumstances, the optimum air/fuel ratio is not achieved and higher emission levels are again experienced.

The shortcomings of a carburetted system have been somewhat eliminated by certain fuel injection systems on the market. With a fuel injection system, the fuel management is provided with a rather precise control of the fuel being fed to the engine which results in improved driveability without unwanted surges, lower emission levels, convenient changes of the calibration of the system, and the system may be operated in a closed loop mode of operation.

As the importance of electronic fuel injection systems continues to increase because of their adaptability for economy fuel metering and emission control, the actual valving devices or fuel injectors of such systems are becoming more critical to the operation of such systems as the limiting factors of operation.

The preferred valving device for the modern internal combustion engine injection system is the electromagnetically operated solenoid type. The solenoid valve is relatively fast acting and accurate while being compatible and easily interfaced with modern electronic air/fuel ratio controllers. Controlling the opening and closing times of the injectors electronically provides a powerful technique for adapting the air/fuel ratio with respect to a program or prestored schedule to control emissions. Normally, the electromagnetic injectors are either specifically designed for either single point or multipoint operation.

In the single point operation, usually one injector is configured to deliver fuel at one general distribution point, conventionally the air induction bore of a throttle body connecting to a plane of a manifold arrangement. A fast acting high capacity solenoid valve is needed in this arrangement since the injector must work twice as fast as in a multipoint arrangement while delivering twice the fuel for an eight cylinder engine. An advantageous single point system specially adapted to a dual plane manifold arrangement is disclosed in issued U.S. Pat. No. 4,142,683 entitled "Electric Fuel Injection Valve," in the name of G. L. Casey et al. which is commonly assigned. The disclosure of Casey is expressly incorporated by reference herein.

In a multipoint system, a plurality of points are injected in a localized manner, for example each individual cylinder of a multi-cylinder engine. A fuel rail or fuel manifold is required to supply these systems at relatively high pressures. This high pressure fuel enters one end of the injector and passes through a restrictive passage to where it is metered from an exit orifice into the vicinity of the intake valve of the cylinder. A multipoint fuel injection system of this type is illustrated in a U.S. Pat. No. 3,788,287 issued to Falen et al. The disclosure of Falen is expressly incorporated herein by reference.

With a multipoint system, there are problems involved in the hot starting of the automobile and hot fuel handling due to the fact that the injectors are positioned very close to the high heat areas of the engine, as are the fuel lines feeding the injectors. This creates vaporization of the fuel resulting in a low quantity of fuel being injected per pulse to create a lean air/fuel ratio. Further, the multipoint fuel injection system requires the high pressure fuel system with the inherent sealing problems and the cost of a high pressure pump.

It would therefore be desirable to provide an injector that could interchangeably be utilized in either single or multipoint systems. Also, a rapid substitution injector for either type system would be a very positive advantage of such a valve.

SUMMARY OF THE INVENTION

The invention provides a rapid substitution electromagnetically operated fuel injection valve which is interchangeable in either a single point or a multipoint electronic fuel injection system. With a readily interchangeable injector valve, manufacturing facilities and tooling can be consolidated for both systems and the benefits of a standard fuel delivery device in reducing system engineering time obtained.

The fuel injection valve includes a movable valve needle attached to the armature of an electromagnetic solenoid. The valve needle seats between an inlet orifice and a metering orifice of a valve housing which is inserted into an accumulation chamber defined by the inner wall of an injector jacket.

Fuel inlet passages and fuel exit passages are provided to the accumulation chamber which is maintained at a substantially constant pressure by a pressure regulator and fuel pump source. The pump and regulator form a fuel circuit which recirculates fuel from a reservoir or tank to the accumulation chamber and back again. The volume of the accumulation chamber and recirculating fuel are advantageous for substantially reducing hot fuel handling problems such as cavitations, bubbles, or vapor.

A flexible of soft connection retains the valve housing in the accumulation chamber to seal the chamber without any direct fuel connection to the injector valve. This soft connection permits the injection valve to be rapidly substituted if it becomes non-operable. The substitution can be accomplished without disconnecting and reconnecting fuel conduits to the valve. A further advantage is that during the remounting of an injector in a fuel rail of a multipoint system leakage problems will not be encountered. Generally, this is important for a multipoint system where there are four times as many injectors as are usually found in a single point system for a V8 engine.

The inlet orifices in the preferred implementations of the injector valve housing are located in closest proximity to metering orifice and are separated only by the closure of the needle valve. Fuel in the accumulation chamber is therefore not encumbered by a restrictive passageway to the metering orifice and a low pressure fuel pump for the system can be utilized.

The injector valve further has a detachable valve tip which forms a seal between the valve seat of the metering orifice and the needle valve. Implementations of the valve tip for forming a hollow cone fuel spray utilized advantageously in single point systems or for forming a relatively straight spray for multipoint systems are provided by the invention. Preferred embodiments of the inlet orifices of the valve housing further will provide a hollow cone spray for a single point injection system.

A specific single point implementation for the rapid substitution injection valve includes a throttle body having one or more air induction bores formed therein. The number of bores usually corresponds to the number of manifold planes which exist in the intake manifold of the engine. The preferred implementation is a dual bore system metering fuel to a double plane intake manifold for a V-8 engine.

Each induction bore has an injector jacket mounted with a coaxial relationship to the air flow of the bore such that the metering orifice of the injection valve is centered therein above the throttle blade. The jacket is suspended in this location by a bridge structure whose inner bore defines the fuel inlet passage and fuel exit passage to the accumulation chamber of the injector jacket.

The fuel exit passage is elevated with respect to the inlet passage in order to have vapor and bubbles always transported toward the pressure regulator and away from the accumulation chamber. The angle or degree of elevation provided is at least as great as the maximum angle an operator of an automobile would park on a hill.

The elevation of the fuel passage to the accumulation chamber, the accumulation chamber and the suspension of the accumulation chamber away from heat producing areas of the engine all enhance the hot fuel handling characteristics of this implementation.

The specific use of the wide angled spray embodiments of the injector valve in this implementation and the positioning of the metering orifice produce an enhanced atomization of the delivered fuel charge. The hollow cone spray is directed at the turbulent areas formed by the restriction of the opening throttle plate and causes a break up of the spray and a mixing of the fuel and air into a combustible charge. This action is especially important at partial throttle positions where a relatively small area between the throttle plate and induction bore must be injected with substantially all of a small pulse of fuel to maintain the correct air/fuel ratio.

A particular multipoint implementation includes an injector jacket that is adapted for mounting in proximity of the air flow path of the intake valve of a cylinder of an engine. Each cylinder will have an associated jacket for fuel delivery. A rapid substitution injector mounts into each jacket and meters fuel into the associated cylinder upon actuation of the solenoid controlled needle valve. This implementation has an input fuel flow from a pressurized source to a pressure regulator and recirculates fuel from the source through the inlet and exit passages of each jacket in a serial fashion to the regulator.

Therefore, it is a primary object of the invention to provide a fuel injection valve for an electronic fuel injection system that can be rapidly disconnected from such system and remounted.

It is another object of the invention to provide a rapid substitution injector that is interchangeable in either single point fuel injection systems or multipoint fuel injection systems.

It is still another object of the invention to provide an improved single point fuel injection system including a rapid substitution injection valve.

It is a further object of the invention to provide an improved multipoint fuel injection system including a rapid substitution injection valve.

It is yet another object of the invention to ameliorate hot start problems associated with fuel management systems.

It is yet still another object of the invention to provide improved hot fuel handling characteristics in single and multipoint fuel injection systems.

Another object of the invention is to provide a fuel injection valve that is compatible with low pressure fuel injection systems of either the single point or multipoint type.

These and other objects, features, and aspects of the invention will be more fully described and more readily apparent from reading the following detailed description if taken in conjunction the appended drawings wherein:

BRIEF DESCRIPTION OF THE DRAWINGS

FIG. 1 is a top view of a single point fuel injection system for a dual plane multi-cylinder induction manifold and according to the invention is provided with rapid substitution injectors;

FIG. 2 is a reverse side view of the single point injection system illustrated in FIG. 1;

FIG. 8 is an enlarged partial view of a modification for the injector tip shown in FIG. 7;

FIG. 9 is an enlarged partial side view in cross section of a further modification of the injector tip illustrated in FIG. 8;

FIG. 10 is an enlarged partial side view in cross section of a further modification to the valve housing of the injector illustrated in FIG. 8;

FIG. 11 is an enlarged partial side view in cross section of a further modification to the injector tip illustrated in FIG. 8;

DETAILED DESCRIPTION OF THE PREFERRED EMBODIMENT

Figure 3:
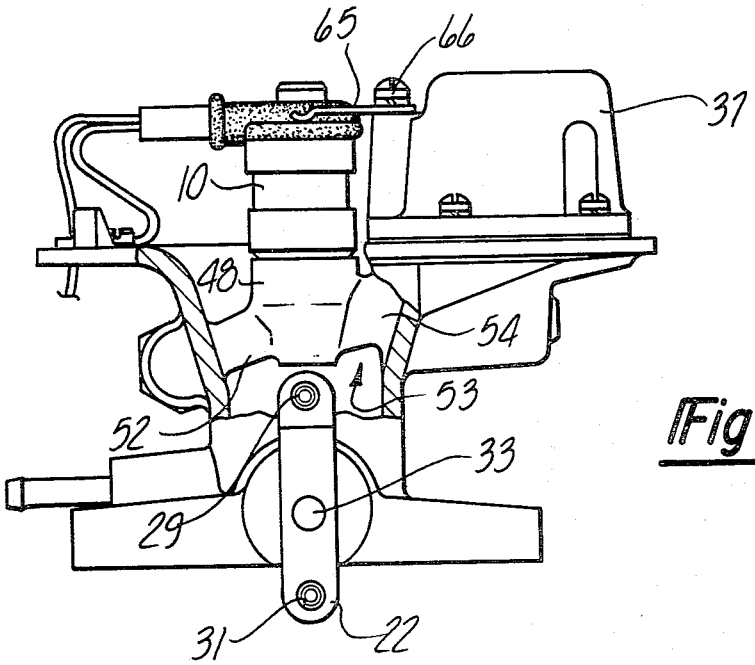
FIG. 3 is an obverse side view of the single point fuel injection system illustrated in FIG. 1.

FIG. 1 shows in a top view the mounting of rapid substitution injectors 8, 10 into an advantageous single point throttle body generally designated 12. Each injector 8, 10 is operable to meter fuel into an air induction bore 14 and 16 respectively. The air flow through the bores is controlled conventionally by a pair of ganged throttle plates 18 and 20 which rotate to open an increasing passageway to air flow in response to the operation of a throttle linkage 22.

Fuel enters the throttle body of the system from a fuel inlet passage 24 shown in a dotted configuration from a fuel inlet port 25 which is connected to a source of pressurized fuel (not shown). A cam operated fuel pump attached to a fuel line of a gas tank, as found in a conventional automobile, would be a preferred choice for the source. The source, as will be noted later, need only provide between 9–15 psi of fuel pressure since the system is a low pressure fuel delivery apparatus. The usual high pressure fuel source for electronic fuel injection systems is not needed in this system with a resultant economy in overall fuel delivery cost.

From the inlet passage 24, the fuel passage 24 bifurcates into fuel delivery passages 26, 28 which open to accumulation chambers 30 and 32 as shown in phantom. The fuel continues its transmission from the accumulation chambers 30, 32 through the fuel delivery passages 26, 28 to a collection chamber 34 of a pressure regulator 37.

From the collection chamber 34, the fuel passes through a regulated pressure port 36 which communicates with a fuel exit passage 38 ending in a fuel exit port 40 where it is returned by conventional tubing or the like to the fuel reservoir or fuel tank.

The pressure regulator 37 controls the opening and closing of the regulated port 36 to provide a constantly recirculated fuel flow and substantially constant pressure at the accumulator chambers 30 and 32. The injectors 8, 10 then meter fuel from the accumulator chambers 30, 32 into the air induction bores 14 and 16 respectively in response to electrical control signals via control cables 42 and 44 which pass through a grommet 46. Ground cables 41, 43 of the injectors 8, 10 are conveniently connected to the throttle body 12 at terminal post 45.

The electrical control signal is developed from an electronic control unit and provides signals for timing the opening and closing of the individual injection valves 8, 10. Although many electronic control units could be used for providing pulse width modulated control signals to the injection valves, the preferred timing and control unit for the illustrated single point system is described in the incorporated Casey reference and will be more fully described herein.

As better illustrated in FIG. 2, the fuel inlet port 25 is located below fuel exit port 40 and can be conveniently connected to conduit or fuel lines for recirculating the fuel by conventional fuel fittings 23, 35 respectively. Upstanding tabs 11, 13, 15 and 17 are provided along the periphery of the throttle body 12 for the mounting of an air cleaner as is generally known.

Figure 4:
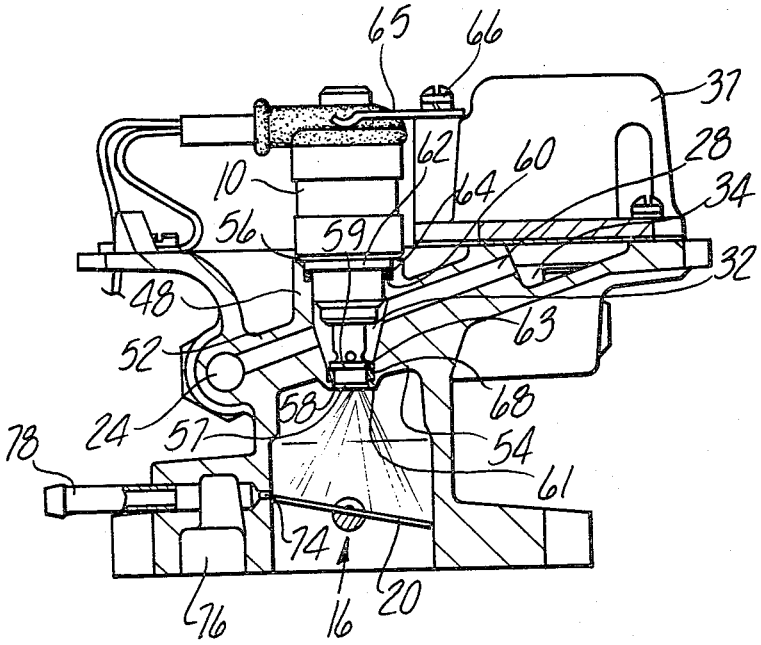
FIG. 4 is a cross sectional side view of the single point injection system illustrated in FIG. 1 and taken along lines 4—4 of that figure.

With reference now to FIGS. 2, 3, and 4, there is shown the mounting and support for one of the rapid substitution injectors, for example the injector referenced 10. The accumulation chamber 32 is defined as the inside bore or wall of a substantially cup-shaped injector jacket 48. Each injector jacket 48 is laterally supported in a coaxial relationship with its associated air induction bore by a bridge structure 53, including a lower wing 52 and an upper wing 54 shown in cross section. The fuel delivery passage 28 is formed by an inner bore through the lower wing 52 and the upper wing 54. The bridge 53 as seen in FIG. 3 is streamlined and suspends the injector jacket 48 above the throttle blade of the bore. The elongated shape of the injection valve 10 and injector jacket 48 permit the air flow into the bore to flow freely around them and offer few projections to create turbulence.

The throttle blade of each bore is controlled by the linkage 22 of FIG. 3 to rotate open or closed in response to forces applied to pins 29, 31. For example, a spring can be connected to pin 31 to provide a closure torque on the throttle blade mounting rod 33 if the force is directed to the right as seen in the drawing. An operator controlled cable connected to pin 29 will provide an opening torque to rod 33 if the force it applies is also directed to the right.

With respect to FIG. 4, the fuel delivery passage 28 is canted at an upward angle, for example in the preferred embodiment between 15°–20° because this angle of bore provides a passage for vapor and air bubbles to pass to the collection chamber 34 instead of remaining in the accumulation chamber or passage. Importantly, according to one of the aspects of the invention, it has been found that even when an auto is parked on a hill this angle will provide enough upward bias to the vapor to allow it to collect and be dissipated in the chamber 34 instead of becoming a vapor lock in the passages or accumulation chamber.

The injector jacket 48 has upper and lower mounting apertures 56 and 58 respectively into which the injector 10 is adapted to mount directly. The injector jacket 48 is further provided with a supporting shoulder 60 which is of slightly greater diameter than the body of the injector 10 and supports a mounting ring 62 press fitted onto the injector 10. An O-ring 64 hydraulically seals the abutment of the ring 62 and the shoulder 60.

This produces a very tight hydraulic seal without the necessity of providing a great deal of downward pressure on the injector to form a leak resistant type fitting. A simple spring-type clip 65 held by a screw 66 retains the injector in the jacket 48.

The lower mounting aperture 56 similarly receives a slightly smaller radial flange 57 of an injector end cap 59. The end cap further is provided with a larger radial flange 63 which is brought into abutment when the injector is inserted in the jacket 48. A suitably designed O-ring 68 is located in the recess in the end cap 59 defined by the radial flange 57 and radial flange 63 and thus seals the abutment of the mounting shoulder 61 and the flange 63.

It is evident that the injector 10 may be mounted or removed from the jacket 48 with relative ease. The injector is devoid of any hard fuel connection from the pressurized source and is provided functionally as an electronically controlled valve to meter fuel from the accumulation chamber 32. If an injector becomes nonfunctional in the system, it may be replaced without disconnecting and reconnecting fuel supply lines. Further, the fuel delivery passages remain integral or intact when the injector is replaced and do not have to be returned.

The sealed accumulation chamber 32 configuration has the advantage of providing a substantially constant fuel pressure to the injector 10 and will not, even under many rapid openings, produce a substantially pressure drop. The accumulation chamber 32 also aids in handling hot fuel in concert with the elevated fuel delivery passage 28. The chamber 32 provides a volume in which vapor and bubbles can be transported or rise to the passage 28 and away from the injector matering tip. The inlet orifices to the injection valve are located below the delivery passage 28 to provide this action. Importantly, this will not permit the vapor to be trapped within the injection valve where it will be harder to purge. The fuel volume contained within the valve is also relatively small for this reason.

FIG. 4 further illustrates that the injector 10 for this single point configuration is a wide-angled spray injector. The wide-angled (in cross section) or hollow cone spray pattern is more advantageous than a straight pattern injection when the injector 10 is mounted concentrically with the air induction bore 16 and above the throttle blade as shown by the drawings. Generally, the air for the system is inducted through larger and larger areas or openings as the throttle plate rotates. These openings are defined by the air induction bore wall and the throttle blade periphery. If the fuel is injected in a hollow conical spray that is aimed or directed toward these openings, the turbulence created by the air being accelerated through the restriction between the throttle blade and the air induction wall will cause good vaporization and fuel distribution.

The angle of the spray cannot be too great or it will wet the walls of the air induction bore, and cannot be too small or it will be injected upon the throttle plate and condense. Therefore, a compromise has to be worked out taking into account the distance the injector is from the throttle and the bore opening diameter. Generally for the embodiment shown in the figure, an included spray angle of between 60° to 80° is thought to provide an optimum result as to vaporization and mixing with the inducted air. Throttle bodies with different sized bores will have the mounting distances adjusted accordingly. The methods of obtaining the open hollow conical spray pattern would be more fully described hereinafter with respect to the detailed description of the injector, the valve housing, and valve tip.

The throttle body is further provided with a vacuum sensing port 74 that communicates to the air induction bore 16 in proximity to the closed throttle position of the throttle. As the air is restricted between the throttle plate 20 and the inner wall of the bore, a vacuum or pressure drop will occur. This vacuum is integrated in a sealed measuring chamber 76 and communicated to a sensor via a tubular fitting 78. As seen in FIG. 1, the level of vacuum delivered from the tubular fitting 78 may be averaged with the vacuum of the other air induction bore 14 as via a similar tubular fitting 80 and common conduit 81 to provide a totalized vacuum signal from the entire throttle body via a pressure sensor 83.

Figure 5:
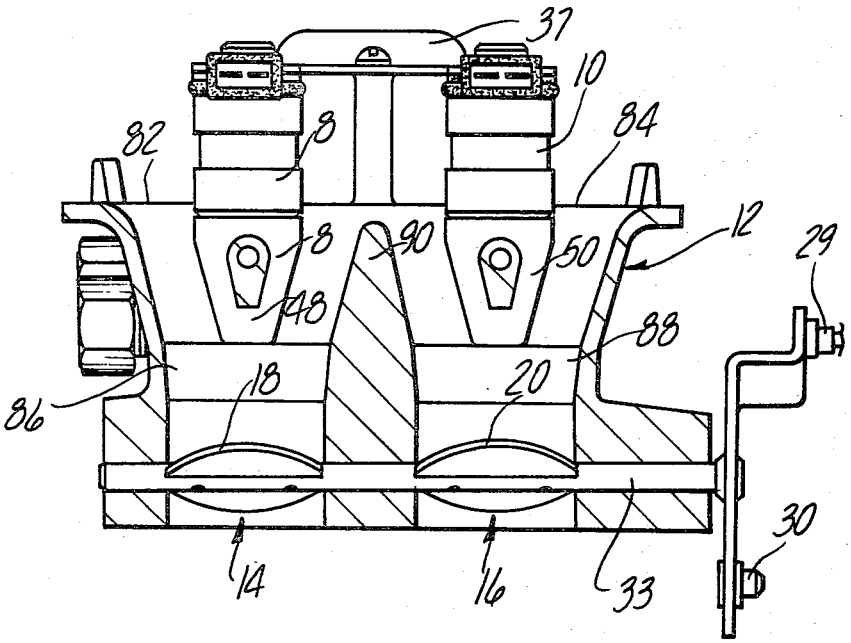
FIG. 5 is a cross sectional front view of the single point fuel injection system illustrated in FIG. 1 and taken along lines 5—5 in that figure.

FIG. 5 shows the injectors 8 and 10 mounted in injector jackets 48 and 50 respectively and a cross section of the air induction bores 14 and 16. It is seen that the injector jackets are streamlined and tapered to provide a smooth air flow past the outlines of the concentrically mounted injectors. Air is directed into the bores by the flaring tapers 82 and 84 which accelerate the air smoothly into the air induction bores. The bores are wide enough at this region so they provide an annular area with the injectors mounted that does not restrict the air flow significantly into the throttle body. The tapers 82 and 84 end with a slight counter bore 86 and 88 respectively which interface the irregular areas of the tapers to the generally circular air induction bore throttle areas.

The flared tapers 82, 84 intersect at a separating centerland 90 which is smoothly flared as are the tapers. The centerland 90, however, is projected to a peak nearly equivalent to the top of the injector jackets. The centerland 90 is to aid in streamlining the air flow and functions to further separate the inducted air into two streams which can then be controlled by the separate throttle plates in the air induction bores 14, 16. This separation of the air stream and the air induction bores at this point prevents fuel splattering from the injectors mounted above the throttle blade and uneven error in fuel distribution. This is necessary as the injectors 8, 10 can be activated at different times independently of one another.

Figure 6:
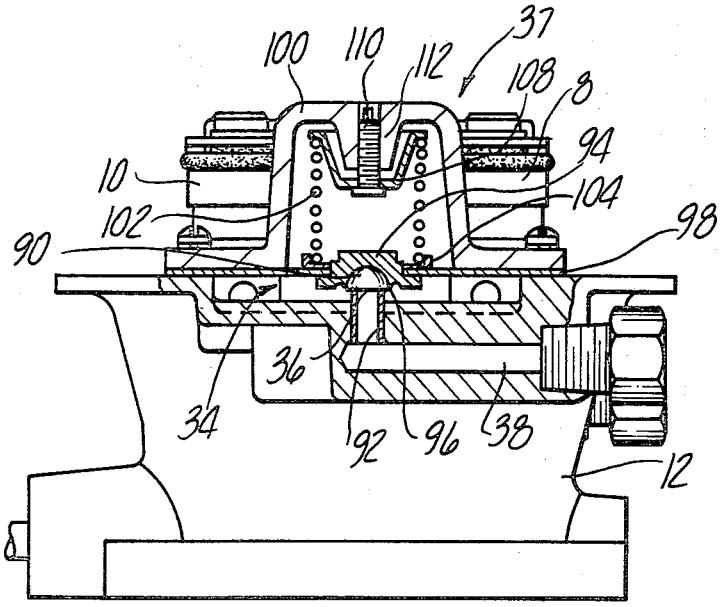
FIG. 6 is a partially sectioned rear view of the single point fuel injector system illustrated in FIG. 1 and sectioned along lines 6—6 of that figure.

With respect now to FIG. 6, the pressure regulator 37 will now be more fully explained. The regulator 37 comprises a valve assembly which opens and closes the regulated port 36 in response to pressure changes within the collection chamber 34. An exit pipe 92 mates flatly with the truncated side of a hemispherical valve 90. The spherical portion of the valve 90 fits into a similarly shaped recess in a valve plate 94 and is retained by crimp 96 in the plate. The shape of the valve and recess in the valve plate allow the plate to move around for varying conditions of pressure but will always permit the valve to seat flat upon the lip of the exit pipe 92 upon a valve closure.

The valve plate 94 mounts onto a diaphragm member 98 which acts not only as a flexible pressure regulator but a seal for the collection chamber 34 and may be retained by a regulator cover 100 which is bolted to the throttle body 12. Threadably mounted onto the valve plate on the other side of the diaphragm is a retainer plate 104 which has upraised lips to retain a compression spring 102. The compression spring 102 is compressed by a spring retainer cup 108 being adjusted via an adjusting bolt 110 which threads into an upraised boss 112 on the regulator cover. By adjusting the bolt 110, the compression spring will provide a variable force against the diaphragm 98 and seat the valve 90 with an initial pressure setting.

When the fuel pressure in the collection chamber 34 becomes greater than this initial pressure, the valve 90 will be lifted from mating with the exit pipe 92 and fuel will be passed through the fuel exit passage 38 to lower the pressure until the compression spring 102 closes the valve 90.

The higher the compressive force of the spring, the higher the pressure that can be produced in the system, but normally with a conventional fuel pump a low pressure system is maintained in the collection chamber as described previously. The separate collection chamber that is regulating the pressure for the system will not substantially change the pressure in the accumulation chambers 30, 32 and, therefore, they will remain substantially constant according to one of the objects of the invention.

The throttle body is specifically useful when mounted on a dual plane manifold A preferred manifold would be that illustrated in FIG. 2 of the incorporated Casey et al. reference. In this particular instance air induction bore 14 would feed a mixed air and fuel charge into manifold chamber 72 and air induction bore 16 would similarly feed manifold chamber 70. The tubular fitting 78 and 80 would then face the front of the automobile as is evident.

The timing of the control signal pulse to the injectors 8, 10 is preferably the identical timing used for the single point system disclosed in the Casey et al. reference. The circuitry of that disclosure can be utilized by connecting conductors 42 and 44 to the driver circuits 634 and 636 (FIG. 18 of Casey et al.) to receive a train of pulse width control signals $TP_1$ and $TP_2$. This, of course, is timing that will be particularly used for a V8 engine. Specifically each injector 8, 10 is fired alternately with pulses every 90° of an engine cycle. The pulses will be initiated 45° BTDC of the next cylinder to go into an intake cycle and will be of a duration calculated by the ECU from an open loop schedule and its closed loop correction.

Figure 15:
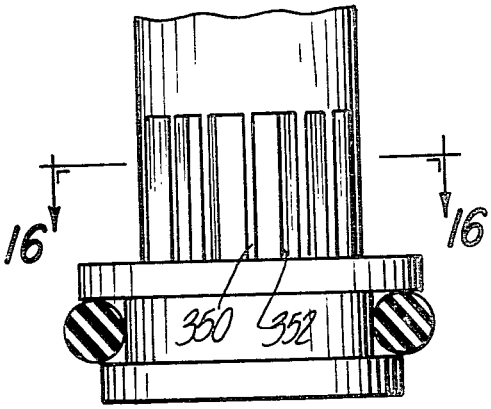
FIG. 15 is an enlarged partial side view of a further modification to the valve housing illustrated in FIG. 12.

FIG. 15 of Casey et al. discloses that for a firing order of cylinders 1, 4, 6 and 7 of manifold chamber 72 injector 8 will be pulsed at 90°, 270°, 450° and 630° of the crankshaft. It will then be understood that the other injector 10 will be pulsed at 180°, 360°, 540° and 720° for cylinders 2, 3, 5 and 8 of manifold chamber 70. A reading of 90° on the crankshaft is referenced as 45° BTDC of cylinder 1 and its intake cycle.

Figure 7:
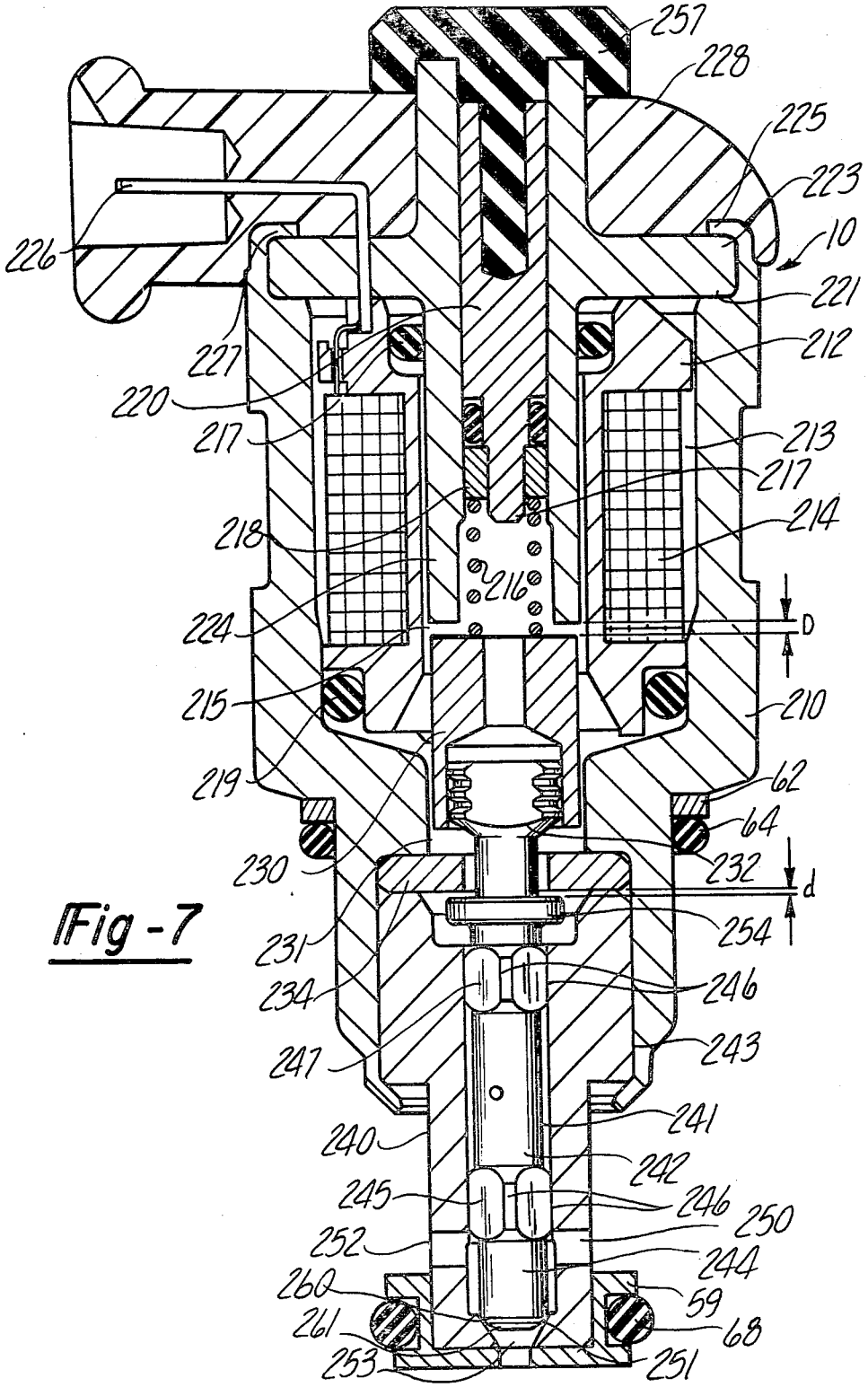
FIG. 7 is a cross sectional side view of a rapid substitution injector constructed in accordance with the invention.

The rapid substitution electromagnetic valve 10 shown in FIG. 7 to advantage, is comprised of an injector housing 210 having a large coil assembly mounting bore 213 into which is slideably mounted a solenoid coil assembly. The coil assembly includes a plastic or molded bobbin 212 wound with a coil 214. A substantially cylindrical coil core 224 is mounted or received in a bobbin bore 215 and locks the bobbin within the mounting bore 213 by means of a radial flange 223 which rests against shoulder 221. The flange is crimped by end pieces 225 and 227 to firmly hold the coil assemblies within the mounting bore 213.

The core 224 extends nearly the entire length of the coil 214 in the bobbin bore and is preferably manufactured of a material which will concentrate the flux of the coil into an coaxial magnetic field having a concentrated pole at either end of the coil. Thus, for strength and durability, the core 224 may be made out of a soft iron or other material that is non-remanent. The coil is further connected to a set of terminal pins on which is shown as terminal 226 which pass through the flange 223 of core 224 and is molded into a hard plastic molding 228. The pins are bent before molding to form substantially a right angle with the longitudinal axis of the injector and thus provide a low profile for the injector. Suitable O-rings 217, 219 seal the bobbin bore 215 and the mounting bore 213, respectively.

At the other end of the injector is a valve assembly comprising a needle valve 242 and an armature 230. The armature 230 which is manufactured of a magnetically attractable material reciprocates in an armature bore, 231 and transports needle valve 242 therewith. The needle valve 242 is positioned within a valve bore 241 of a valve housing 240 by machined surfaces 246 which have been made by machining circular collars on the needle valve 242 and thereafter cutting flats 245 and 247 away from the collars. The needle valve 242 additionally includes a valve tip 244 which seats against a valve seat 251 which tapers conically into a metering orifice 253.

The valve bore 241 is provided as the central coaxial bore in the valve housing 240 which mounts into a valve assembly bore 243 within the injector housing 210. The valve housing is spaced away from a shoulder on the injector housing by a C-shaped spacer 234 which is machined to an exacting thickness. The distance between the end of the bore 241 and the valve housing 240 is also of an exact length providing for an accurate gap between a valve collar 254 and the edge of the spacer 234. Thus, an accurate length of throw for the valve may be maintained without having to specially machine the armature which is threaded onto the end of the needle valve 242 by a threaded end 232.

The valve tip 244 is seated against the valve seat 251 by the pressure of a closure spring 216 which abuts a thrust washer 218 mounted upon an end pin 217 of an adjusting rod 220. The adjusting rod 220 will force the spring into contact with the armature and depending upon the distance it is compressed and will provide a different spring force constant for the armature to work against.

In the preferred embodiment, the spring is tightened until an excellent seat is formed without applying a great deal of pressure in order to retain the fast acting aspects of the injector. Once the correct tension has been placed upon the spring, the casing may be pinched to hold the rod in the correct position. A plug 257 is used to seal the adjusting rod once a calibration has been accomplished. Preferably, the opening time of the injector which is dependent upon the solenoid should be approximately equivalent to the closing time. Generally, the heavier the compression of the spring the faster the injection valve will close.

In operation, as current is applied to terminal pins 226, the flux in coil 214 will begin to rise and be concentrated in core 224. The magnetic field set up by this flux concentration will attract the armature 230 against the downward force of the spring 216 and when overcome, the armature will begin to move to the upward as is shown in FIG. 7. The armature will move through the air gap D, a set distance d, the spacing between the collar 254 and the spacer 234. The collar when it abuts the surface of the spacer 234 will stop further movement of the needle valve and produce a fully opened valve opening at seat 251. Fuel entering inlet orifice 250, 252 will flow into the valve bore 241 past the valve tip 244 and out the metering orifice 253.

It is seen that the valve housing 240 has a mounting end cap 59 attached at the end of the valve housing 240. The end cap is mounted with a cut circular recess, and an O-ring 68 which seals it against an inner surface of a mounting aperture. The injection valve is further provided with a ring 64 on which an O-ring 64 may be mounted to seal this portion of the injection valve and an accumulator aperture. These elements have been previously described with respect to their functions in connection with the injector jacket and will not be further elaborated on.

In the incorporated Casey et al. reference, it was noted that a multipoint injector is usually fired twice per engine cycle and is burdened with one-eighth of the fuel load. A single point injector as described must, however, fire four times each engine cycle and carries half the total fuel delivery requirements. Thus, each injection must deliver twice the fuel in half the time for the single point system. For a single point application such as described, a rapidly actuated high capacity injection valve is a necessity. It is evident that for the valve to be interchangeable in either system, the limiting operation will be because of the single point application.

The injector tip 244 enhances the rapid actuation of the injection valve illustrated in FIG. 7. The tip 244 has two truncated conical surfaces 260, 261. Surface 260 seals against the valve seat 251 and is of lesser slope than surface 261 and produces a very narrow seal relatively high on valve seat 251. When the valve is opened, only a very short opening distance is needed to provide a maximum area for the fuel to flow.

Since the inlet orifices 250, 252 are located near the valve tip, substantially no restricion to the fuel flow is encountered. In low pressure systems with high flow rates, this injector does not lose considerable capacity due to a pressure drop because of a restrictive passage.

To this point the rapid substitution injector 10 has been illustrated in a single point fuel injection environment. The injector, however, is equally advantageous in multi-point applications as is illustrated by the embodiment shown in FIG. 12.

The injector is shown mounted in a jacket 300 similar to the jacket for the single point application with an upper mounting aperture 302 and a lower mounting aperture 304. The injector 10 may be inserted within the mounting apertures to rest upon the shoulders 306 and 308 as described previously and seal the mounting apertures hydraulically from leakage. The injector jacket is further provided with clips 310, 312 that may be affixed to the sides of the jacket in a conventional manner and have hook ends 314, 316 which snap over and engage a ridge of the injector body.

For a multipoint application, the injector jacket 300 is provided with threads 314 which can be mated with a suitably threaded bore of a boss or aperture manufactured in proximity to the intake valve of a cylinder. Fuel would be provided in a conventional manner to the jacket accumulator 315 via a conduit 318 which fits onto a nipple 320 that threads into a drilled and tapped portion of the accumulator housing. The fuel under low pressure would be metered into the proximity inlet valve through the inlet orifices 322, 324 and 326 in response to the actuation of the needle valve and be metered through the metering orifice into the cylinder. For multi-cylinder engines, each cylinder would have a jacket 300 connected to the source of pressurized fuel and thereafter have a rapid substitution injector inserted into the jacket for an operable system. Pressurized fuel would flow from the source to the accumulator chamber via the inlet passage and then be communicated to the next injector via an exit passage. A pressure regulator will recirculate the fuel in a serial fashion from injector to injector. Further, each exit passage can be elevated with respect to its entrance passage. Thus, it is seen that a single injector design may be used for either single point or multi-point applications in accordance with one of the important objects of the invention. Since the multipoint injector is generally less critical as to timing and response speed than the single point application, the redesign of the lift and coil components of the armature are not necessary.

Figure 12:
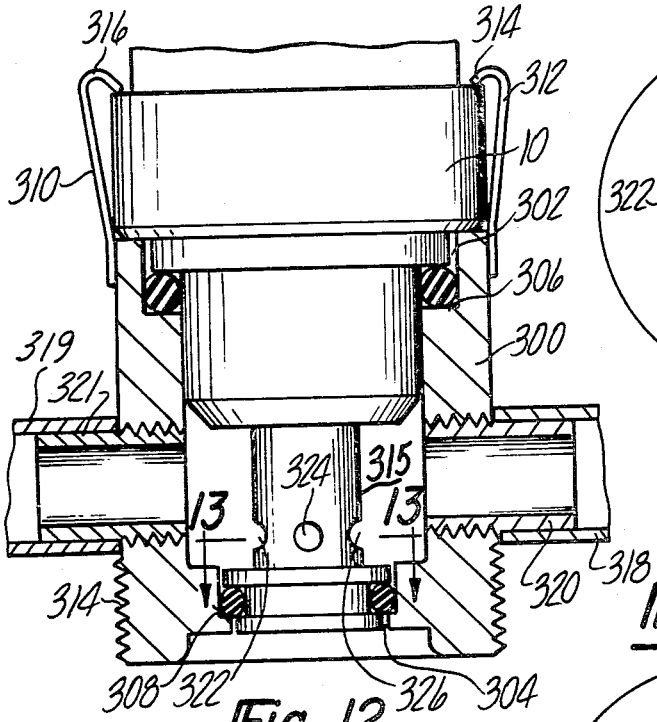
FIG. 12 is a cross sectional side view of an injector jacket for a multipoint system including the mounting configuration for a rapid substitution injector according to the invention.
Figure 13:
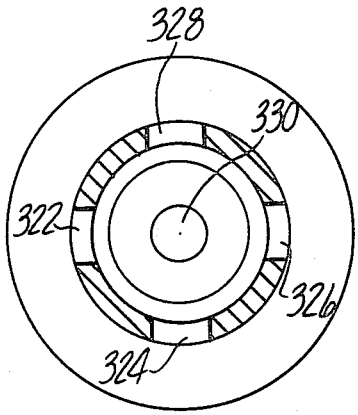
FIG. 13 is a cross-sectional top view of the injector valve housing taken along lines 13—13 of FIG. 12.
Figure 14:
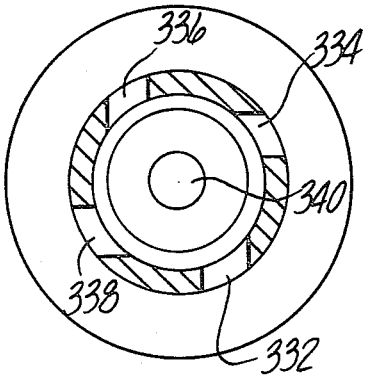
FIG. 14 is a cross sectional top view of a modification of the valve housing shown in FIG. 13.

FIG. 13 taken in cross section along line 13—13 in FIG. 12, illustrates the inlet orifices 322, 324, 326 and 328 are all equally spaced circular apertures to provide a low pressure drop between the accumulator and the metering orifice 330. A modification to the valve housing and the inlet orifices is illustrated in FIG. 14 where the orifices 332, 334, 336 and 338 have been drilled in an offset configuration. This configuration will provide a swirling and turbulent action to the fuel that enters the housing between the needle valve and the metering orifice 340. Such a swirling action because of the modification to the housing will provide a hollow conical spray for single point applications as is indicated as one of the objects of the invention.

Figure 20:
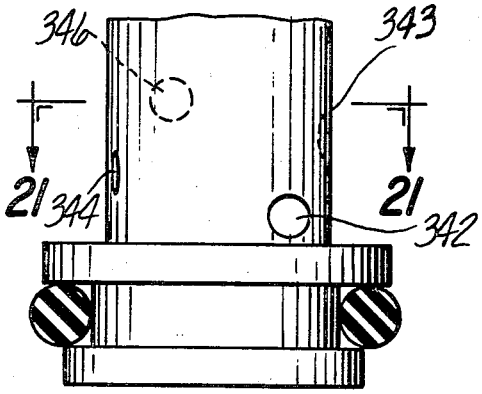
FIG. 20 is an enlarged partial side view of a further modification to the valve housing for the injector illustrated in FIG. 12.
Figure 21:
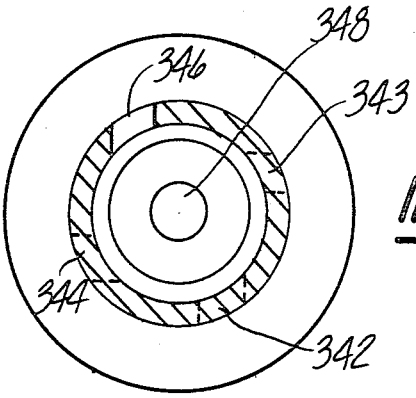
FIG. 21 is a cross sectional top view of the valve housing shown in FIG. 20 and taken along lines 21—21 of that figure.

FIG. 20 shows a further modification of this offset inlet orifice embodiment where inlet orifices 342, 343, 344, and 346 are tangentially offset from each opposing orifice and are also at a different elevation as can be better seen in FIG. 21.

FIG. 21 which is a cross section taken along line 21—21 of FIG. 20 shows the different elevations of the inlet orifices 342, 343, 344, 346. The offsetting of the elevation of the orifice within the valve housing causes additional momentum to be developed by gravitation and an enhancement of the swirling action for a hollow cone fuel spray from the metering orifice 348.

Figure 16:
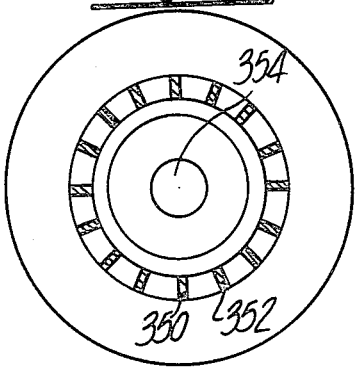
FIG. 16 is a cross sectional top view of the valve housing shown in FIG. 15 and taken along lines 16—16 of that figure.

FIG. 15 shows still another embodiment of the injector housing which may have the inlet orifices formed as wedge shaped slots cut into the housing to provide little restriction to the fuel flow and to create turbulence to break up the flow as it passes by the slot blades 350, 352 into the metering orifice 354. FIG. 16 which is a cross section taken along line 16—16 in FIG. 15 shows that the blades 350, 352 are equally spaced around a diameter of the injector housing.

Figure 17:
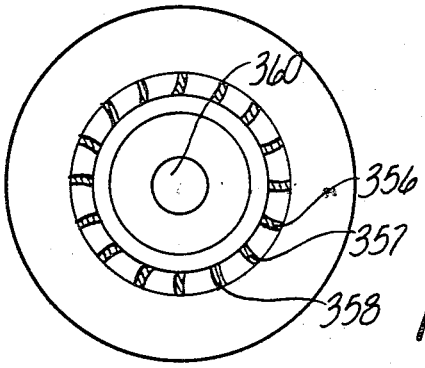
FIG. 17 is a cross sectional top view of a modification of the valve housing shown in FIG. 15.

FIG. 17 is a still further modification of the embodiment shown in FIG. 16 where the slot blades 356, 357,

358, for example, are cup-shaped and rounded to impart a momentum or swirling action and change the direction of the fuel flowing into the space between the valve needle and the metering orifice 360. This embodiment will produce a hollow cone spray pattern for single point applications.

Figure 18:
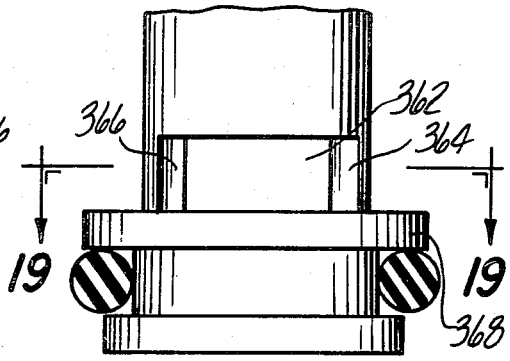
FIG. 18 is an enlarged partial side view of a further modification to the valve housing for the injector illustrated in FIG. 12.
Figure 19:
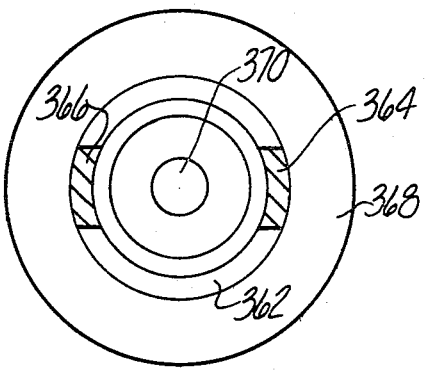
FIG. 19 is a cross sectional top view of the needle housing illustrated in FIG. 18 and taken along line 19—19 of that figure.

A further embodiment is shown in FIG. 18 wherein a wide slot 362 has been machined across the face of the valve housing and leaves posts 364, 366 which connect to the portion of the valve housing supporting the injector end cap 368. As can be better seen in FIG. 19, which is a cross section taken along lines 19—19 in FIG. 18, the slot 362 allows the maximum area to be provided for fuel flow into the area between the injector needle and the metering orifice 370. This is one of the simplest valve housings to machine as a simple cut will provide the requisite opening or orifice. Also, no significant restriction is presented to the fuel flow other than the metering orifice once the injection valve is opened.

Returning now to FIGS. 8 through 11, there are shown various modifications and embodiments of the needle valve tip and end cap for the purpose of proving a hollow cone or wide angle spray pattern for the injection valve.

Referring now to FIG. 8, there is shown a valve housing 372 in which reciprocally slides needle valve 374 with an interchangeable valve tip 376. An end cap 378 is provided to mate with the end of the valve housing 372 and includes an exit aperture 380. The needle tip 376 is provided as exchangeable or interchangeable and is affixed onto a pin 382. Because of wear and tolerance concerns, the tip 376 may be made from a different material to provide a more suitable mating surface 384 against valve seat 386 than would be possible if the entire valve needle 374 was of one material. Further, it is noted that the valve seat 386 has a conical taper at a certain angular degree which is substantially similar to the counter bore 388. Another aspect of this embodiment illustrates the metering interface 390 is maintained as small as possible to provide a smooth acceleration through the metering orifice and exit flow to the delivery point.

FIG. 9 shows a further modification of the embodiment illustrated in FIG. 8 where a wide serpentine groove has been helically wound around the injector tip 376. In operation, this embodiment when needle valve 374 is lifted and fuel enters through inlet orifices 394 and 396, will produce a swirling motion and in concert with the counter bore 388 and narrow interface 390 will produce a hollow conical spray pattern as previously described.

FIG. 10 is a further modification of the embodiment shown in FIG. 8 where the inlet orifices 398 and 400 have been drilled angularly with respect to the metering orifice. In operation, this embodiment when the needle valve 374 lifts the needle tip away from the valve seat 386 and a hollow conical spray pattern as described previously. It is noted that for the most advantageous use of this implementation that the apertures 398, 400 should be imparted at an angle substantially equal to the conical taper of the valve seat 386.

FIG. 11 is a still further modification of the embodiment shown in FIG. 8 where a deflection pintle has been attached to the valve tip 376. When the needle valve 374 is lifted and transports valve tip 376 away from the seat 386, fuel will rush into the interface 390 and encounter an annular opening between the sides of the interface and the deflection pintle 402. The center of the fuel will be directed outwardly along the curves of the pintle 402 to provide a more evenly distributed hollow cone spray pattern.

In this embodiment, the deflection pintle 402 is particularly advantageous compared to previously described swirl implementation since for very short pulse widths the momentum of the fuel will not provide a swirling or a conical spray action until the injector has been opened for a short time. Thus, this embodiment would be particularly advantageous not only for general hollow cone spray patterns needed for multi-point or single point but particularly for the above throttle single point application previously described because of the short opening times necessitated by the injector timing considerations.

While it will be apparent that the embodiments of the invention herein disclosed are well calculated to fulfill the objects of the invention, it will be appreciated that the invention is susceptible to modification, variation and change without departing from the proper scope or fair meaning of the invention as defined in the appended claims.

What is claimed is:

1. A fuel metering assembly including a rapid substitution injection valve for single point and multipoint fuel injection systems, said valve assembly comprising;

an independently formed injector jacket having a fuel inlet passage for receiving pressurized fuel and for communicating said fuel to an accumulation chamber defined by an inside wall of said fuel injection jacket; said injector jacket further having a fuel exit passage directly connected to the accumulation chamber for communicating said fuel from the accumulation chamber, the inlet and exit fuel passages supplying said accumulation chamber with a circulating quantity of fuel under a substantially constant pressure;

a rapid substitution injection valve including a solenoid and armature which are operably enabled by electronic control signals to the solenoid to produce relative movement between said armature and solenoid;

a needle valve slideably reciprocable in a bore of a valve housing and having a valve tip that seals a metering orifice located at one end of the valve housing, said needle valve afixed to said armature such that the control signals will open and close the metering orifice;

at least one inlet orifice formed in the valve housing and disposed such that said inlet orifice is proximate to the valve tip and metering orifice, said proximity causing the inlet orifice to provide substantially no restriction to a metered fuel flow through the inlet orifice to the metering orifice;

said valve housing of said injection valve being inserted into a pair of mounting apertures formed in said injector jacket such that said inlet orifice of the valve housing communicates with said accumulation chamber and said metering orifice extends outside of said accumulation chamber, means for hydraulically sealing said valve housing and said accumulation chamber from fuel leakage.

2. A fuel metering assembly as disclosed in claim 1 wherein said valve tip includes:

means for imparting a hollow cone spray pattern to the fuel flow injected from said metering orifice.

3. A fuel metering assembly as disclosed in claim 2 wherein said means for imparting a hollow cone spray pattern include:

a serpentine groove helically formed in said valve tip and imparting rotational momentum to the fuel flow injected from said metering orifice.

4. A fuel metering assembly as disclosed in claim 2 wherein said means for imparting a hollow cone spray pattern include:

a pintle attached to the valve tip and extending through said metering orifice, said pintle having a formed curvature that imparts momentum directed outwardly from the direction of fuel flow.

5. A fuel metering assembly as defined in claim 2 wherein said hollow cone spray pattern makes an angle with its base of between 60° and 80°.

6. A fuel metering assembly as disclosed in claim 1 wherein said valve housing includes:

means for imparting a hollow cone spray pattern to the fuel flow injected from said metering orifice.

7. A fuel metering assembly as disclosed in claim 6 wherein said means for imparting a hollow cone spray pattern includes:

said inlet orifice is formed tangetially to the injection direction such that rotational momentum is imparted to fuel flowing therethrough.

8. A fuel metering assembly as disclosed in claim 7 including a plurality of tangential inlet orifices, and wherein said means for imparting a hollow cone spray pattern includes:

elevating each tangential inlet orifice on a different plane to produce increased rotational momentum in said fuel flow.

9. A fuel metering assembly as disclosed in claim 6 wherein said means for imparting a hollow cone spray include:

said inlet orifice is a bore drilled angularly to the direction of the fuel flow injected from the metering orifice.

10. A fuel metering assembly as defined in claim 6 wherein said hollow cone spray pattern makes an angle with its base of between 60° and 80°.

* * * * *